US006478000B2

(12) United States Patent
Ishii et al.

(10) Patent No.: US 6,478,000 B2
(45) Date of Patent: Nov. 12, 2002

(54) VALVE TIMING CONTROL APPARATUS AND METHOD FOR INTERNAL COMBUSTION ENGINE

(75) Inventors: Yoshikazu Ishii, Okazaki (JP); Makoto Nishimura, Okazaki (JP); Masahiro Ozawa, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/902,275

(22) Filed: Jul. 11, 2001

(65) Prior Publication Data

US 2002/0014215 A1 Feb. 7, 2002

(30) Foreign Application Priority Data

Jul. 31, 2000 (JP) ..... 2000-231174

(51) Int. Cl.[7] ..... F01L 1/34
(52) U.S. Cl. ..... 123/90.17; 123/90.15
(58) Field of Search ..... 123/90.15, 90.17, 123/90.12, 90.27, 90.31

(56) References Cited

U.S. PATENT DOCUMENTS

| | | | |
|---|---|---|---|
| 5,738,056 | A | 4/1998 | Mikame et al. |
| 5,816,204 | A | 10/1998 | Moriya et al. |
| 5,870,983 | A | 2/1999 | Sato et al. |
| 5,924,395 | A | 7/1999 | Moriya et al. |
| 6,039,016 | A | 3/2000 | Noguchi |
| 6,302,072 | B1 | 10/2001 | Sekiya et al. |

FOREIGN PATENT DOCUMENTS

| | | |
|---|---|---|
| EP | 0 845 584 A1 | 6/1998 |
| EP | 0 859 130 A1 | 8/1998 |
| EP | 1 008 729 A2 | 6/2000 |
| JP | A 11-62521 | 3/1999 |
| JP | A 11-182214 | 7/1999 |
| JP | A 11-210424 | 8/1999 |
| JP | A 11-241608 | 9/1999 |
| JP | A 2000-170509 | 6/2000 |

OTHER PUBLICATIONS

U.S. patent application Ser. No. 09/431,924, filed Nov. 2, 1999.

*Primary Examiner*—Weilun Lo
(74) *Attorney, Agent, or Firm*—Oliff & Berridge, PLC

(57) ABSTRACT

During a course of stopping an engine, the oil pressure in a timing advance-side hydraulic chamber and the oil pressure in a timing retard-side hydraulic chamber of a variable valve timing mechanism are adjusted so that the relative rotation phase of an intake camshaft changes to the timing advanced side of a phase (predetermined advanced state) corresponding to the engine start-up timing. After the relative rotation phase has changed to the advanced side of the predetermined advanced state, the duty ratio D, that is, a control quantity used to adjust the oil pressure, is fixed to a value that holds the relative rotation phase.

22 Claims, 9 Drawing Sheets

COMMAND TO STOP
START OF STOPPING

DUTY RATIO D
80%
H±A%
0%
t

AMOUNT OF ADVANCEMENT
0
θ1

ENGINE REVOLUTION SPEED NE
IDLING SPEED
VALUE b

OIL PRESSURE IN ADVANCE-SIDE HYDRAULIC CHAMBER
0
TIME

VALVE TIMING CONTROL APPARATUS AND METHOD FOR INTERNAL COMBUSTION ENGINE

INCORPORATION BY REFERENCE

The disclosure of Japanese Patent Application No. 2000-231174 filed on Jul. 31, 2000, including the specification, drawings and abstract is incorporated herein by reference in its entirety.

BACKGROUND OF THE INVENTION

1. Field of Invention

The invention relates to a valve timing control apparatus and a valve timing control method for an internal combustion engine.

2. Description of Related Art

Internal combustion engines, such as vehicle-installed engines and the like, are provided with valve timing control apparatus for varying the engine valve timing for the purpose of output increase, emission improvement, etc. An example of such valve timing control apparatus is described in Japanese Patent Application Laid-Open No. 11-210424.

The valve timing control apparatus described in the aforementioned laid-open patent application includes a variable valve timing mechanism that varies the relative rotation phase of a camshaft with respect to the crankshaft of the internal combustion engine based on the fluid pressure in a timing advance-side pressure chamber and the fluid pressure in a timing retard-side pressure chamber. An oil control valve operates to adjust the oil pressure in the two hydraulic chambers based on a predetermined control quantity, and a lock mechanism and a stopper mechanism fix the relative rotation phase of the camshaft in a predetermined advanced state in which the relative rotation phase is advanced by a predetermined amount from a most retarded state. During idle operation, the valve timing control apparatus performs a control so as to bring the relative rotation phase of the intake camshaft to a nearly most retarded state, so that suitable intake valve timing will be achieved. Furthermore, using the lock mechanism and the stopper mechanism, the valve timing control apparatus sets a control range of valve timing control such that the valve timing reaches a startup timing. The valve timing control apparatus fixes the relative rotation phase via the lock mechanism and the stopper mechanism at engine start-up, and discontinues the fixation of the relative rotation phase during an ordinary engine operation, thereby preventing the reduction of the control range of valve timing control while optimizing the valve timing at engine start-up.

During the course of stopping the internal combustion engine during which the engine revolution speed gradually decreases from an idle revolution speed, the aforementioned valve timing control apparatus changes the relative rotation phase of the intake camshaft from a phase near the most retarded state that is suitable for the idle operation, to the vicinity of a phase corresponding to the start-up timing, that is, to a predetermined range that is slightly to the advanced side of the phase corresponding to the start-up timing. After changing the relative rotation phase, the valve timing control apparatus is able to fix the relative rotation phase to a phase that is suitable for a start-up operation, by using the lock mechanism and the stopper mechanism. During the course of engine stopping, the valve timing control apparatus changes the relative rotation phase of the intake camshaft to the advanced side, that is, to the phase corresponding to the start-up timing, by setting the control quantity of the oil control valve to a value that maximizes the oil pressure in the timing advance-side hydraulic chamber.

With this setting of the control quantity during the engine course of stopping, the relative rotation phase is first changed to a phase (predetermined advanced state) on the advanced side of the phase corresponding to the start-up timing. Then, as the oil pressure in the timing advance-side hydraulic chamber decreases with decreases in the engine revolution speed, the relative rotation phase changes toward the phase corresponding to the start-up timing in a direction to the retarded side because the reaction force involved in the opening and closing of the intake valves acts on the intake camshaft as a rotating torque toward the retarded side. Thus, during the engine stopping process, the valve timing control apparatus changes the relative rotation phase to the phase corresponding to the start-up timing, so as to establish a state in which the aforementioned fixation by the lock mechanism and the stopper mechanism can be performed.

Furthermore, this valve timing control apparatus changes the relative rotation phase immediately before the stopping of the engine is initiated (during the idle operation), to an appropriate state beforehand in accordance with a parameter, such as the idle revolution speed or the like, that affects the oil pressure in the timing advance-side hydraulic chamber during the idle operation, so that at the time of completion of the stopping of the engine, the relative rotation phase reaches the vicinity of the phase corresponding to the start-up timing. By changing the relative rotation phase for the idle operation beforehand in the above-described manner, it becomes possible to precisely bring the relative rotation phase to the vicinity of the phase corresponding to the start-up timing, when the stopping of the engine is completed.

However, if the relative rotation phase is changed during the idle operation as described above, the idle operation of the engine may become unstable since the changed relative rotation phase is not an optimal phase for the idle operation.

SUMMARY OF THE INVENTION

It is one object of the invention to provide an internal combustion engine valve timing control apparatus capable of changing the relative rotation phase of a camshaft to a vicinity of a predetermined advanced state (a phase corresponding to the start-up timing) during the course of stopping the engine, without altering the relative rotation phase during the idle operation from an appropriate state.

In accordance with one aspect of the invention, an internal combustion engine valve timing control apparatus includes: a variable valve timing mechanism, a stopper, a fluid pressure adjustor and a control quantity controller. The variable valve timing mechanism varies a relative rotation phase of a camshaft with respect to a crankshaft of an internal combustion engine based on a fluid pressure in a timing advance-side hydraulic chamber and a fluid pressure in a timing retard-side hydraulic chamber. The stopper (fixing means) fixes the relative rotation phase of the camshaft at a predetermined advanced state that is advanced from a most retarded state by a predetermined amount, with respect to at least a timing retarded side. The fluid pressure adjustor (fluid pressure adjusting means) is controlled based on a predetermined control quantity to adjust the fluid pressure in the timing advance-side hydraulic chamber and the fluid pressure in the timing retard-side hydraulic chamber. The control quantity controller (control quantity setting means) sets the control quantity so that the relative rotation phase of the camshaft becomes a state that is on an advanced side of the predetermined advanced state during a course of stopping the internal combustion engine, and then sets the control quantity to a value that holds the relative rotation phase of the camshaft.

According to the above-described construction, the control quantity used to control the fluid pressure adjustor is set (fixed) to a value that holds the relative rotation phase of the camshaft after the relative rotation phase has changed to the advanced side of the predetermined advanced state during the course of stopping the internal combustion engine. During this state, the relative rotation phase of the camshaft is held near the predetermined advanced state and on the advanced side thereof. Therefore, during the course of stopping the engine, the relative rotation phase of the camshaft changes to the vicinity of the predetermined advanced state independently of the state of phase occurring during the idle operation preceding the initiation of stopping the engine. Hence, the control apparatus is able to set the relative rotation phase of the camshaft to a phase suitable for the idle operation during the idle operation preceding the stopping of the engine, and to change the relative rotation phase of the camshaft precisely to the vicinity of the predetermined advanced state during the course of stopping the engine.

BRIEF DESCRIPTION OF THE DRAWINGS

The foregoing and further objects, features and advantages of the invention will become apparent from the following description of a preferred embodiment with reference to the accompanying drawings, in which like numerals are used to represent like elements and wherein.

DETAILED DESCRIPTION OF PREFERRED EMBODIMENTS

A preferred embodiment in which the invention is applied to an automotive engine will be described hereinafter with reference to FIGS. 1 to 10.

Figure 1:
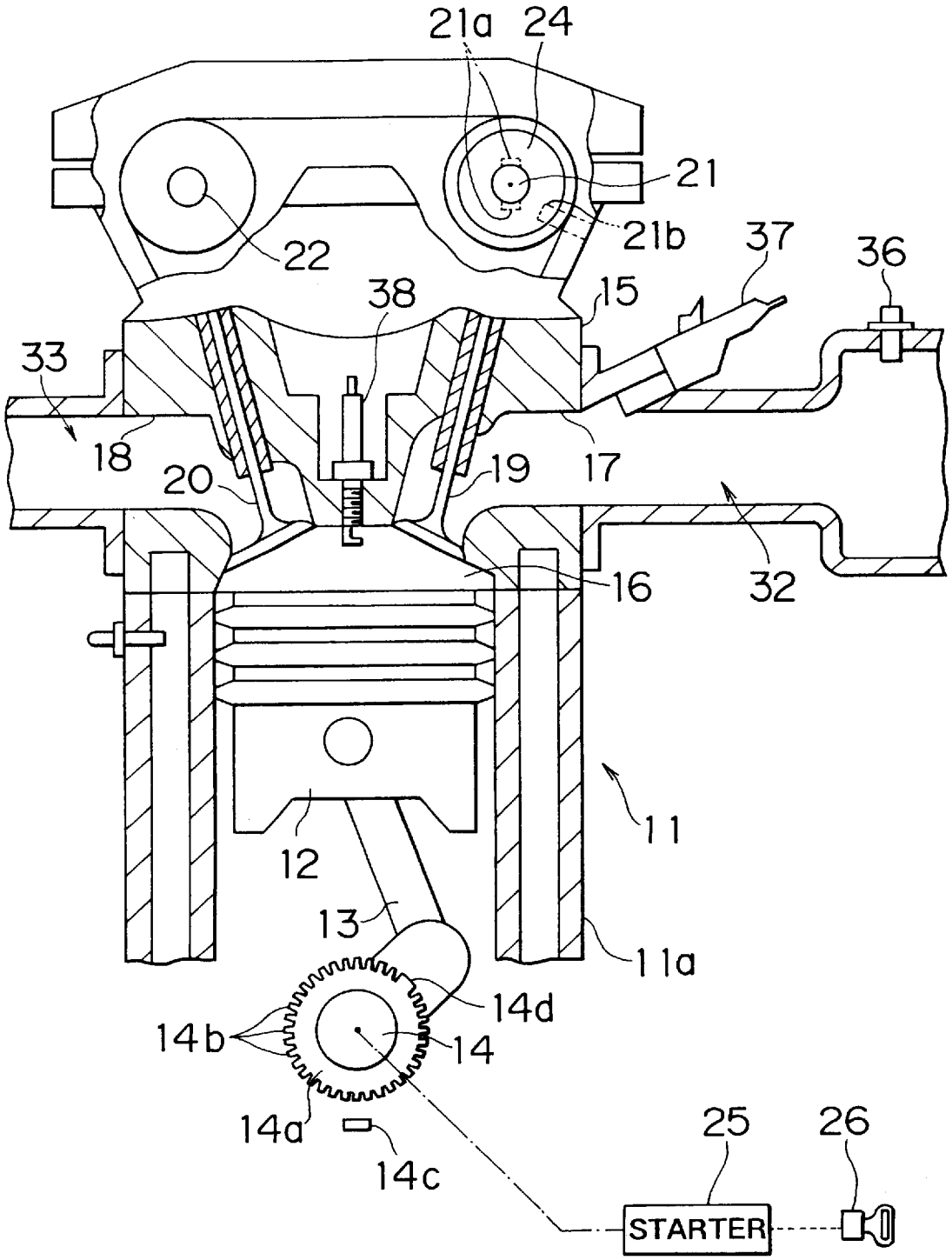
FIG. 1 is a diagram illustrating an overall construction of an engine to which the valve timing control apparatus of an embodiment of the invention is applied.

Referring to FIG. 1, a cylinder block 11*a* of an engine 11 is provided with a total of four pistons 12 (only one of them is shown in FIG. 1) that are disposed for reciprocating movements within cylinders in a one-to-one relationship. The pistons 12 are connected to a crankshaft 14, that is, an output shaft of the engine 11, via corresponding connecting rods 13. Reciprocating movements of the pistons 12 are converted into rotation of the crankshaft 14 by the connecting rods 13. At the time of start-up of the engine 11, the crankshaft 14 is forcibly turned by a starter 25 that is driven based on an operation performed on an ignition switch 26.

The crankshaft 14 is provided with a signal rotor 14*a*. An outer peripheral portion of the signal rotor 14*a* is provided with a plurality of projections 14*b* that are formed at every predetermined angle about an axis of the crankshaft 14. A crank position sensor 14*c* is provided at a side of the signal rotor 14*a*. As the projections 14*b* of the signal rotor 14*a* sequentially pass by the crank position sensor 14*c* during rotation of the crankshaft 14, the crank position sensor 14*c* outputs a pulse-like detection signal corresponding to the passing of each projection 14*b*. A larger projection 14*d* also is provided on the signal rotor 14*a*, and is sensed by the crank position sensor 14*c* to detect when the crankshaft 14 is located at a home position.

A combustion chamber 16 is defined between each piston 12 and a cylinder head 15 disposed on an upper end of the cylinder block 11*a*. Intake ports 17 and exhaust ports 18 formed in the cylinder head 15 communicate with the combustion chambers 16. The intake ports 17 and the exhaust ports 18 also communicate with an intake passage 32 and an exhaust passage 33, respectively. Each intake port 17 and each exhaust port 18 are provided with an intake valve 19 and an exhaust valve 20, respectively.

An intake camshaft 21 and an exhaust camshaft 22 for opening and closing the intake valves 19 and the exhaust valves 20, respectively, are rotatably supported by the cylinder head 15. Rotation is transferred from the crankshaft 14 to the intake and exhaust camshafts 21, 22 via gears, a chain, etc. As the intake camshaft 21 rotates, the intake valves 19 are opened and closed, thereby establishing and blocking the communication between the intake ports 17 and the combustion chambers 16. As the exhaust camshaft 22 rotates, the exhaust valves 20 are opened and closed, thereby establishing and blocking the communication between the exhaust ports 18 and the combustion chambers 16.

A cam position sensor 21*b* that outputs a detection signal upon detecting a projection 21*a* provided on an outer peripheral surface of the intake camshaft 21 is provided on the cylinder head 15, at a side of the intake camshaft 21. As the intake camshaft 21 rotates, the projections 21*a* of the camshaft 21 sequentially pass by the cam position sensor 21*b*. The cam position sensor 21*b* outputs the detection signal at every predetermined interval corresponding to the passing of the projection 21*a*.

A vacuum sensor 36 for detecting the intake pressure of the engine 11 is provided in the intake passage 32. Fuel injection valves 37 for injecting fuel into the intake ports 17 are provided at a downstream end of the intake passage 32. Each injection valve 37 injects fuel into a corresponding one of the intake ports 17 to form a mixture of fuel and air when air is drawn from the intake passage 32 into the corresponding combustion chamber 16 during the intake stroke of the engine 11.

The cylinder head 15 is also provided with ignition plugs 38 for igniting mixture charged into the corresponding combustion chambers 16. When air-fuel mixture burns in a combustion chamber 16 upon ignition, combustion energy causes the piston 12 to reciprocate so as to rotate the crankshaft 14, thereby driving the engine 11. After mixture in each combustion chamber 16 burns, exhaust is pumped out into the exhaust passage 33 by the piston 12 ascending during the exhaust stroke of the engine 11.

Next, a variable valve timing mechanism 24 for varying the open-close timing (valve timing) of the intake valves 19 of the engine 11 will be described with reference to FIG. 2.

Figure 2:
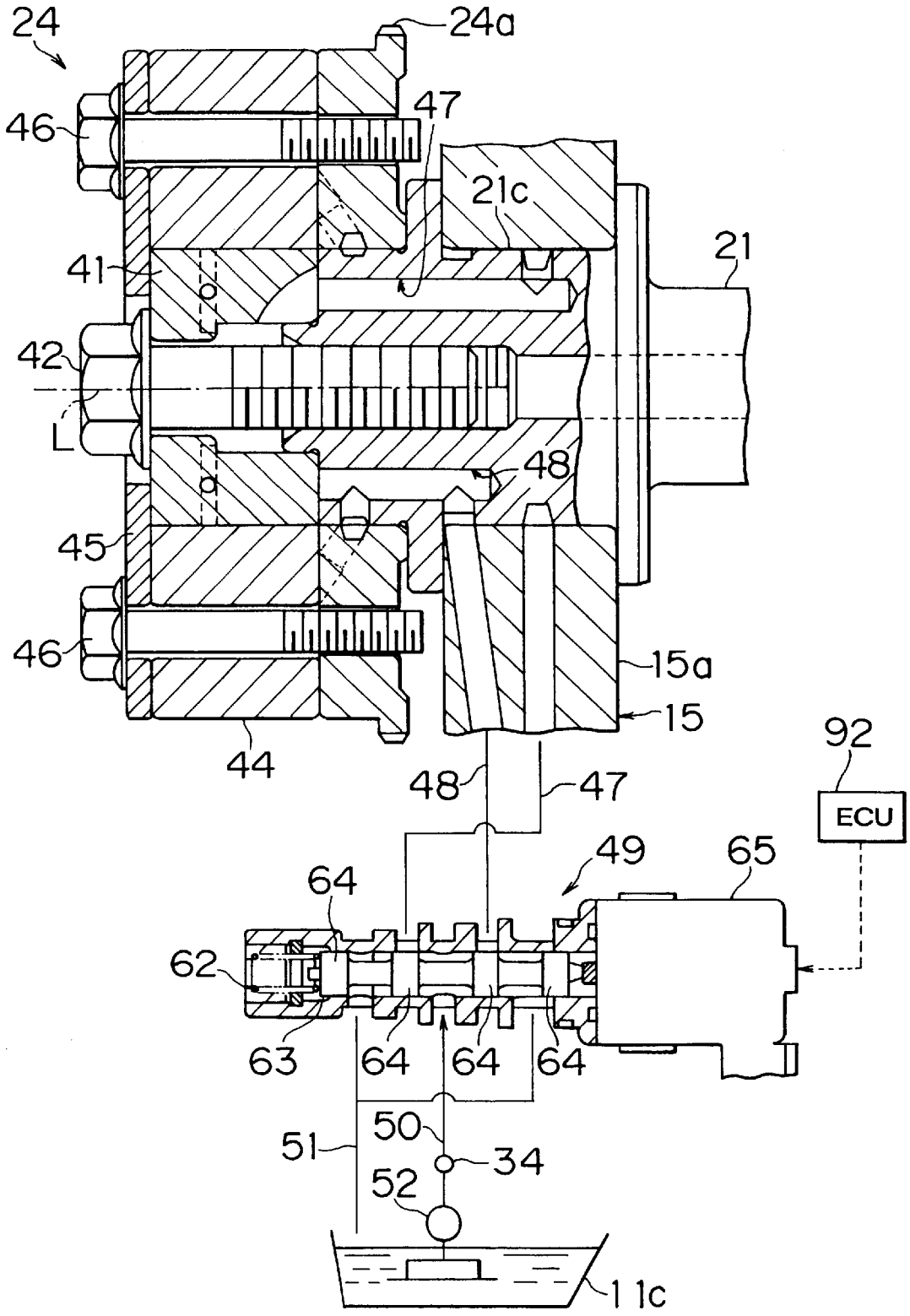
FIG. 2 is a sectional view showing a construction for supplying hydraulic oil to a variable valve timing mechanism.

As shown in FIG. 2, the intake camshaft 21, where the variable valve timing mechanism 24 is mounted, has a journal 21*c* that is rotatably supported by a bearing 15*a* of the cylinder head 15. The variable valve timing mechanism 24 also includes a gear 24*a* to which rotation is transferred from the crankshaft 14 via a chain and the like, and a rotating member 41 that is fixed by a bolt 42 to a distal end face of the intake camshaft 21. The gear 24*a* is rotatable with respect to the intake camshaft 21, which extends through a central portion of the gear 24*a*.

The distal end face (left hand-side face in FIG. 2) of the gear 24*a* contacts a ring cover 44 that is provided in such a manner as to surround the rotating member 41. A distal end opening of the ring cover 44 is closed by a closure plate 45. The gear 24*a,* the ring cover 44 and the closure plate 45 are fixed by bolts 46 so that they are rotatable together. Therefore, the intake camshaft 21 and the rotating member 41 are rotatable together about an axis L of the intake camshaft 21. The gear 24*a,* the ring cover 44 and the closure plate 45 are rotatable about the axis L relatively to the intake camshaft 21 and the rotating member 41.

The variable valve timing mechanism 24 is supplied with hydraulic oil selectively from a timing advance-side oil passage 47 and a timing retard-side oil passage 48 that are formed in the intake camshaft 21 and the like as shown in FIG. 2. When the variable valve timing mechanism 24 is operated by hydraulic oil supplied as mentioned above, the relative rotation phase of the intake camshaft 21 with respect to the crankshaft 14 is changed to the advanced timing side or the retarded timing side, so that the valve timing of the intake valves 19 is changed.

The timing advance-side oil passage 47 and the timing retard-side oil passage 48 are connected to an oil control valve (OCV) 49. A supply passage 50 and a discharge passage 51 are connected to the OCV 49. The supply passage 50 connects to an oil pan 11*c* provided in a lower portion of the engine 11, via an oil pump 52 that is driven as the crankshaft 14 rotates. The discharge passage 51 discharges into the oil pan 11*c*. The pressure in a portion of the supply passage 50 downstream of the oil pump 52 is detected by an oil pressure sensor 34. The amount of hydraulic oil ejected from the oil pump 52 increases as the engine revolution speed increases. Therefore, the value of pressure detected by the oil pressure sensor 34 is higher as the engine revolution speed is higher.

The OCV 49 has a spool 63 that has four valve portions 64 and that is urged in one direction by a coil spring 62 and is urged in the opposite direction by an electromagnetic solenoid 65. In the OCV 49, the position of the spool 63 (valve position) is controlled based on the duty control of the voltage applied to the electromagnetic solenoid 65 via an electronic control unit (hereinafter, referred to as "ECU") 92.

More specifically, if the duty ratio of the voltage applied to the electromagnetic solenoid 65 is set to 100% by the ECU 92, the spool 63 is set to an end side (left-hand side in FIG. 2) overcoming the spring force of the coil spring 62. In this state, the timing advance-side oil passage 47 and the supply passage 50 are placed in communication with each other so that hydraulic oil is delivered from the oil pan 11*c* into the timing advance-side oil passage 47 by the oil pump 52. Furthermore, the timing retard-side oil passage 48 and the discharge passage 51 are placed in communication with each other so that hydraulic oil is returned from the timing retard-side oil passage 48 into the oil pan 11*c*.

If the duty ratio of the voltage application to the electromagnetic solenoid 65 is set to 0%, the spool 63 is set to the opposite end side (right-hand side in FIG. 2). In this state, the timing retard-side oil passage 48 and the supply passage 50 are placed in communication with each other so that hydraulic oil is delivered from the oil pan 11*c* into the timing retard-side oil passage 48 by the oil pump 52. At the same time, the timing advance-side oil passage 47 and the discharge passage 51 are placed in communication with each other so that hydraulic oil is returned from the timing advance-side oil passage 47 into the oil pan 11*c*.

The constructions of the rotating member 41 and the ring cover 44 of the variable valve timing mechanism 24 will next be described in detail with reference to FIG. 3.

Figure 3:
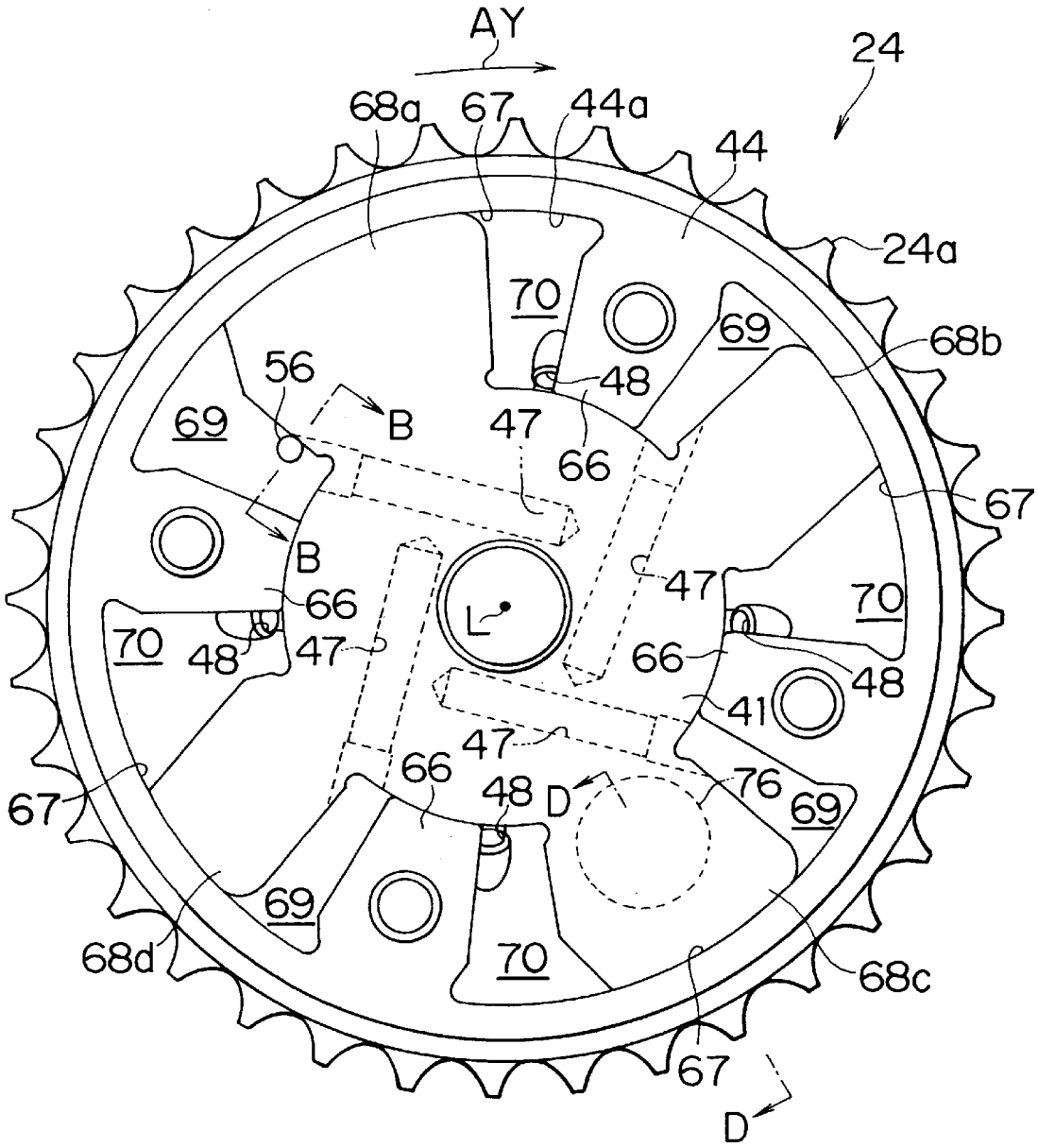
FIG. 3 is a sectional view showing an internal construction of the variable valve timing mechanism.

As shown in FIG. 3, the ring cover 44 has four radially inwardly projecting portions 66 that are protruded from an inner peripheral face 44*a* of the ring cover 44 toward the axis L of the intake camshaft 21 (FIG. 2). The projecting portions 66 are formed at predetermined intervals along the circumference of the ring cover 44. Groove portions 67 are formed between the projecting portions 66, at predetermined intervals along the circumference of the ring cover 44. The rotating member 41 has four vanes 68*a*–68*d* that protrude outward from an outer peripheral face of the rotating member 41 in such a manner that the vanes 68*a*–68*d* are inserted into the groove portions 67. Each one of the groove portions 67 receiving the vanes 68*a*–68*d* is divided into a timing advance-side hydraulic chamber 69 and a timing retard-side hydraulic chamber 70 by the corresponding one of the vanes. The timing advance-side hydraulic chamber 69 and the timing retard-side hydraulic chamber 70 of each groove portion 67 are positioned so as to sandwich the corresponding vane 68*a*–68*d* from opposite sides in the direction of the circumference of the rotating member 41. Each timing advance-side hydraulic chamber 69 communicates with the timing advance-side oil passage 47 extending within the rotating member 41. Each timing retard-side hydraulic chamber 70 communicates with the timing retard-side oil passage 48 extending within the gear 24*a*.

When the duty ratio of the voltage applied to the electromagnetic solenoid 65 of the OCV 49 is set to 100% by the ECU 92, hydraulic oil is supplied from the timing advance-side oil passage 47 into the timing advance-side hydraulic chambers 69 of the variable valve timing mechanism 24 and, concurrently, hydraulic oil is discharged from the timing retard-side hydraulic chambers 70 via the timing retard-side oil passage 48. As a result, the vanes 68*a*–68*d* are relatively shifted in a direction indicated by an arrow AY in FIG. 3, and therefore the rotating member 41 is relatively turned clockwise in FIG. 3. Thus, the relative rotation phase of the intake camshaft 21 with respect to the gear 24*a* (crankshaft 14) is changed. It should be noted herein that when rotation of the crankshaft 14 is transferred to the gear 24*a* via a chain and the like, the gear 24*a* and the intake camshaft 21 are turned clockwise in FIG. 3. Therefore, the relative shifting of the vanes 68*a*–68*d* in the direction of the arrow AY advances the intake camshaft 21 relative to the crankshaft 14, and thus advances the valve timing of the intake valves 19.

When the duty ratio of the voltage applied to the electromagnetic solenoid 65 of the OCV 49 is set to 0% by the ECU 92, hydraulic oil is supplied from the timing retard-side oil passage 48 into the timing retard-side hydraulic chambers 70 and concurrently hydraulic oil is discharged from the timing advance-side hydraulic chambers 69 via the timing advance-side oil passage 47. As a result, the vanes 68*a*–68*d* are relatively shifted in a direction opposite to the direction of the arrow AY, and therefore the rotating member 41 turns counterclockwise in FIG. 3. Thus, the relative rotation phase of the intake camshaft 21 with respect to the gear 24*a* (crankshaft 14) is changed in a direction opposite to the aforementioned direction. In this case, the variable valve timing mechanism 24 retards the angular position of the intake camshaft 21 relative to the crankshaft 14, and thus retards the valve timing of the intake valves 19.

Therefore, by changing the duty ratio of the voltage applied to the electromagnetic solenoid 65 via the ECU 92, the supply and discharge of hydraulic oil with respect to the timing advance-side hydraulic chambers 69 and the timing retard-side hydraulic chambers 70 is controlled so that the oil pressure in the hydraulic chambers 69, 70 is controlled. Thus, by controlling the oil pressure the timing advance-side hydraulic chambers 69 and the timing retard-side hydraulic chambers 70, the valve timing of the intake valves 19 can be changed or can be held in a predetermined state.

However, at the time of start-up of the engine 11, the timing advance-side hydraulic chambers 69 and the timing retard-side hydraulic chambers 70 are in an oil-drained state. Therefore, following the start of supplying hydraulic oil to the hydraulic chambers 69, 70, a predetermined time is needed before an oil pressure that allows the control and fixation of the valve timing is actually secured. Therefore, until a predetermined time elapses following start-up of the engine 11, the valve timing of the intake valves 19 is fixed to a timing suitable for start-up of the engine 11 (hereinafter, referred to as "start-up timing") via a stopper mechanism 56 and a lock mechanism 76 described below. The stopper mechanism 56 is provided at a position corresponding to the timing advance-side hydraulic chamber 69 adjacent to the vane 68*a* in the variable valve timing mechanism 24. The lock mechanism 76 is provided on the vane 68*c* and the like.

Figure 4:
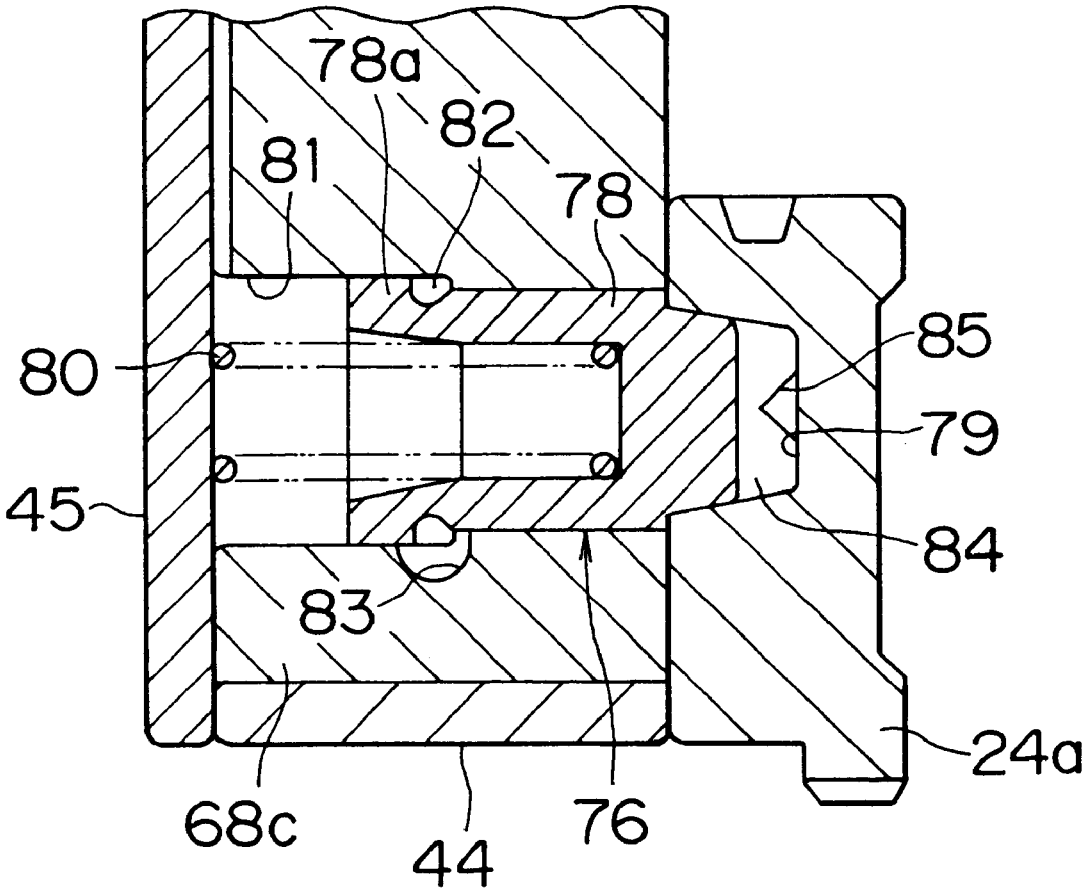
FIG. 4 is a sectional view of a lock mechanism viewed in the direction of arrows D—D in FIG. 3.

The construction of the lock mechanism 76 will next be described in detail with reference to FIG. 4. FIG. 4 is a sectional view of the lock mechanism 76 viewed in a direction indicated by arrows D, D in FIG. 3.

As shown in FIG. 4, the lock mechanism 76 has a lock pin 78 that is provided in the vane 68*c* and that is urged toward the gear 24*a* by a coil spring 80, and a hole 79 that is formed in the gear 24*a* for receiving a distal end of the lock pin 78. The lock pin 78 and the coil spring 80 are disposed in a housing hole 81 formed in the vane 68*c*. A flange 78*a* is formed on an outer peripheral surface of the lock pin 78. The flange 78*a* partially defines a hydraulic chamber 82 within the housing hole 81, at a position toward the distal end of the lock pin 78 from the flange 78*a*. The hydraulic chamber 82 is in communication with the timing retard-side hydraulic chamber 70 via a passage 83, so that the hydraulic chamber 82 is supplied with hydraulic oil from the timing retard-side hydraulic chamber 70. The hole 79 for receiving the distal end of the lock pin 78 has a hydraulic chamber 84 that is defined at a bottom of the hole 79. The hydraulic chamber 84 is in communication with the timing advance-side hydraulic chamber 69 via a passage 85, so that the hydraulic chamber 84 is supplied with hydraulic oil from the timing advance-side hydraulic chamber 69.

The thus-constructed lock mechanism 76 fixes the relative rotation phase of the intake camshaft 21 and discontinues the fixation of the relative rotation phase in accordance with the pressures of the hydraulic oil supplied to the timing advance-side hydraulic chamber 69 and the timing retard-side hydraulic chamber 70, that is, the oil pressures in the hydraulic chambers 69, 70.

When at least one of the timing advance-side hydraulic chamber 69 and the timing retard-side hydraulic chamber 70 is supplied with hydraulic oil during operation of the engine 11, the lock pin 78 is kept in a state where the lock pin 78 is withdrawn from the hole 79 overcoming the spring force of the coil spring 80, by the oil pressure in at least one of the hydraulic chambers 82, 84. In this case, a state is achieved in which the fixation of the relative rotation phase of the intake camshaft 21 (the valve timing of the intake valves 19) in the directions to the timing advanced side and to the timing retarded side by the lock mechanism 76 is removed.

If the rotation speed of the crankshaft 14 gradually decreases during the course of stopping the engine 11, the amount of hydraulic oil delivered to the timing advance-side hydraulic chambers 69 and the timing retard-side hydraulic chambers 70 by the oil pump 52 gradually decreases. As a result, the oil pressure in the timing advance-side hydraulic chambers 69 and the timing retard-side hydraulic chambers 70 decreases, and the oil pressure in the hydraulic chambers 82, 84 of the lock mechanism 76 correspondingly decreases. Then, when the oil pressure decreases to a value that makes it impossible to keep the lock pin 78 depressed within the housing hole 81 against the spring force of the coil spring 80, the lock pin 78 tends to protrude from the housing hole 81 due to the spring force of the coil spring 80. If, at this moment, the valve timing is the start-up timing and the housing hole 81 is precisely aligned with the hole 79, the lock pin 78 is protruded from the housing hole 81 to enter the hole 79, so that the relative rotation phase of the intake camshaft 21 is fixed with respect to both the direction to the timing advanced side and the direction to the timing retarded side.

During the state where the relative rotation phase of the intake camshaft 21 is fixed by the lock mechanism 76 as described above, the range of control of the valve timing of the intake valves 19 is set such that the relative rotation phase of the intake camshaft 21 becomes a phase corresponding to the start-up timing and a predetermined advanced state in which the relative rotation phase is advanced by a predetermined amount from the most retarded state. Therefore, the retarded-side limit of the range of control of the valve timing of the intake valves 19 is set to a timing on the retarded side of the start-up timing. Hence, the range of control of the valve timing of the intake valve 19 becomes broad so that the valve timing of the intake valves 19 can be optimally controlled over the entire region of operation of the engine 11.

Figure 5:
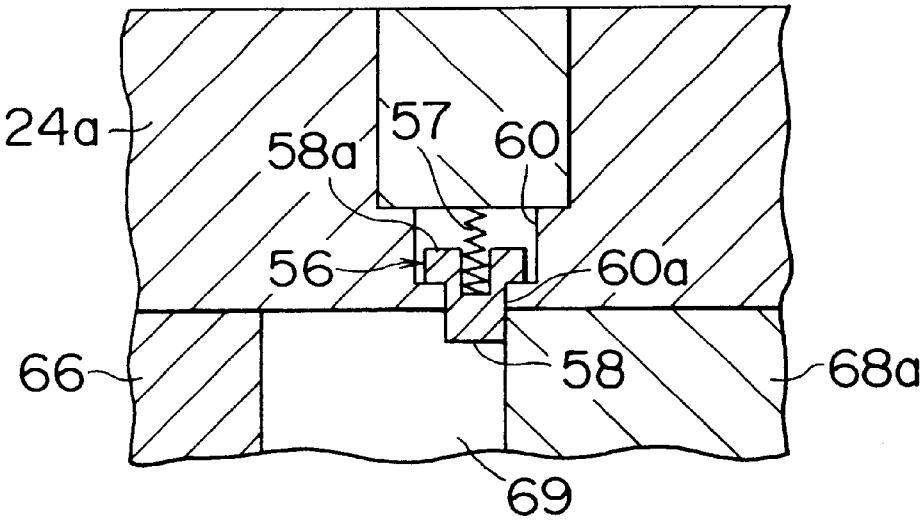
FIG. 5 is a sectional view of a stopper mechanism viewed in the direction of arrows B—B in FIG. 3.

The construction of the stopper mechanism 56 will next be described in detail with reference to FIGS. 5 and 6. FIG. 5 is a sectional view of the stopper mechanism 56 viewed in a direction indicated by arrows B, B in FIG. 3.

As shown in FIG. 5, the stopper mechanism 56 has a stopper pin 58 that is urged from the gear 24*a* toward the inside of the timing advance-side hydraulic chamber 69 by a coil spring 57. The coil spring 57 and the stopper pin 58 are disposed within a housing hole 60 that is formed in the gear 24*a* and that extends in parallel to the axis L of the intake camshaft 21 (see FIG. 3). The stopper pin 58 has a large-diameter portion 58*a*. The housing hole 60 has a small-diameter portion 60*a*. The inside diameter of the small-diameter portion 60*a* is less than the outside diameter of the large-diameter portion 58*a*.

Figure 6:
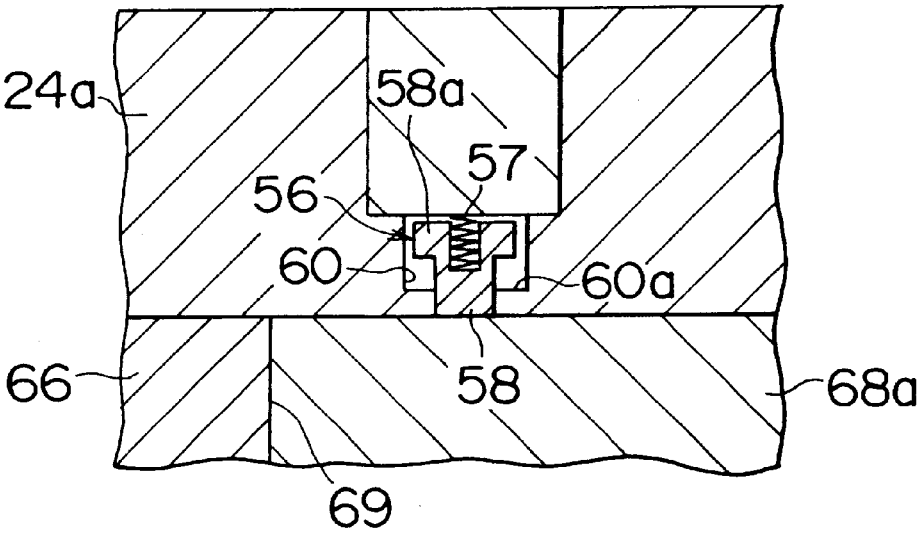
FIG. 6 is a sectional view illustrating a state in which the stopper mechanism is withdrawn into a housing hole.

When the oil pressure in the timing advance-side hydraulic chamber 69 is greater than a predetermined value, the force produced by the oil pressure acts against the spring force of the coil spring 57 so that the stopper pin 58 is depressed into the housing hole 60 as indicated in FIG. 6. Conversely, when the oil pressure in the timing advance-side hydraulic chamber 69 decreases to or below the predetermined value, the stopper pin 58 protrudes from the housing hole 60 into the timing advance-side hydraulic chamber 69 by the spring force of the coil spring 57 as indicated in FIG. 5, on condition that the relative rotation phase of the intake camshaft 21 is a state on the timing advanced side of the phase corresponding to the start-up timing. In this case, the large-diameter portion 58*a* of the stopper pin 58 is stopped by the small-diameter portion 60*a* of the housing hole 60, so that the stopper pin 58 is not excessively protruded into the timing advance-side hydraulic chamber 69.

During the state where the stopper pin 58 is protruded into the timing advance-side hydraulic chamber 69, the stopper pin 58 restricts movement of the vane 68*a* toward the retarded side such that the valve timing of the intake valves 19 changes to the retarded side of the start-up timing. Thus, the relative rotation phase of the intake camshaft 21 is fixed at the phase corresponding to the start-up timing (in the predetermined advanced state) with respect to the direction to the retarded side.

The fixing operation of the stopper mechanism 56 accomplished by protrusion of the stopper pin 58 is performed in accordance with whether the oil pressure in the timing advance-side hydraulic chamber 69 is equal to or less than the aforementioned predetermined value. This predetermined value changes depending on the spring force of the coil spring 57, the pressure-receiving area on the stopper pin 58 that receives the oil pressure in the timing advance-side hydraulic chamber 69, etc. In this embodiment, the spring force of the coil spring 57, the pressure-receiving area of the stopper pin 58 and the like are adjusted so that the predetermined value becomes such a value that the fixing operation of the stopper mechanism 56 precedes the fixation performed by the lock mechanism 76, for example, during the course of stopping the engine 11.

Figure 7:
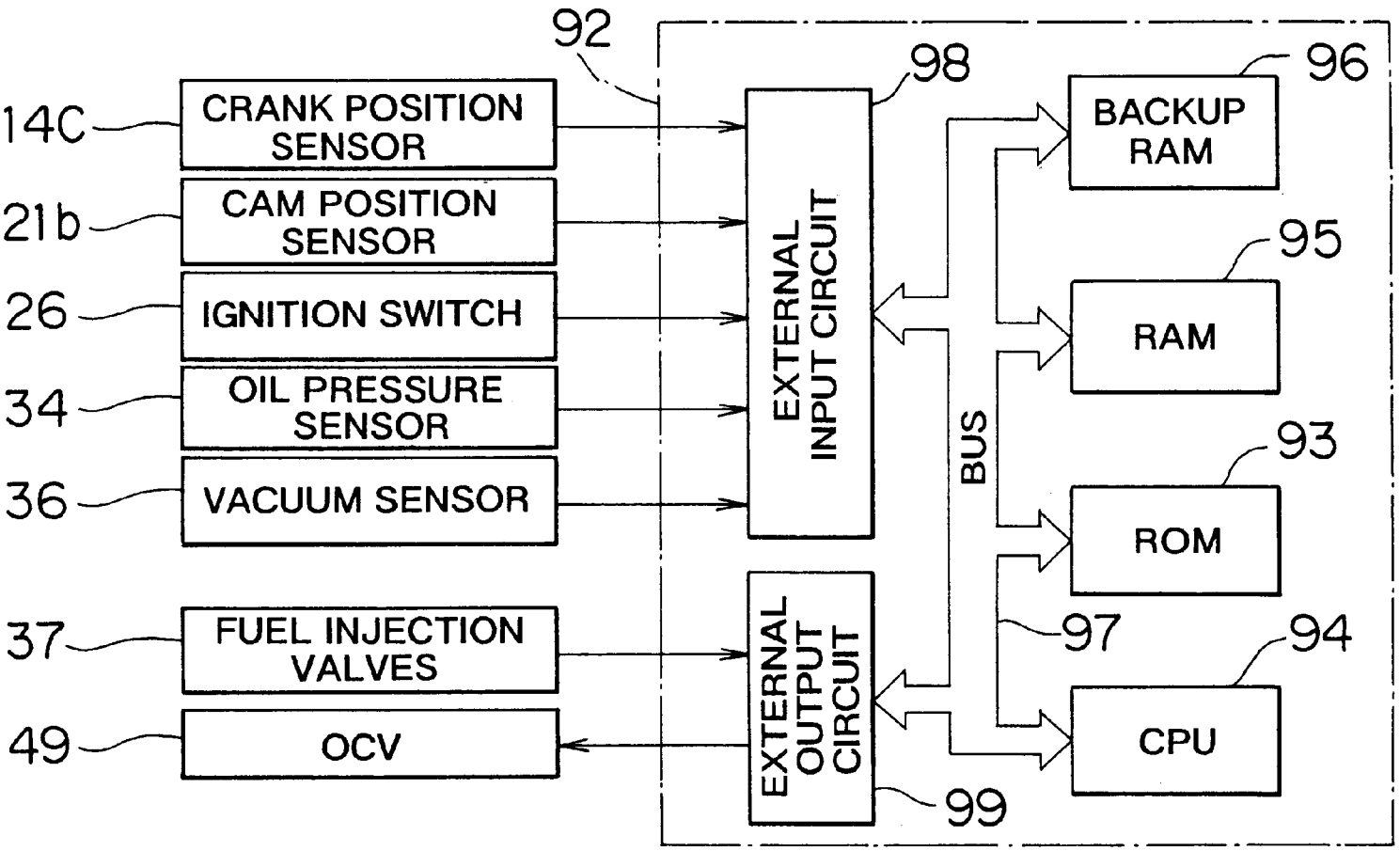
FIG. 7 is a block diagram illustrating an electrical construction of a valve timing control apparatus.

An electrical construction of the valve timing control apparatus of the embodiment will next be described with reference to FIG. 7.

The valve timing control apparatus includes the ECU 92 for controlling the state of operation of the engine 11. The ECU 92 is formed as an arithmetic logic unit having a ROM 93, a CPU 94, a RAM 95, a backup RAM 96, etc.

The ROM 93 is a memory storing various control programs, maps that are referred to during execution of the various control programs, etc. The CPU 94 executes processing based on the control programs and the maps stored in the ROM 93. The RAM 95 is a memory for temporarily storing results of processing executed by the CPU 94, data input from various sensors, etc. The backup RAM 96 is a non-volatile memory that retains the stored data and the like during a stoppage of the engine 11. The ROM 93, the CPU 94, the RAM 95 and the backup RAM 96 are connected to one another and to an external input circuit 98 and an external output circuit 99 via a bus 97.

The external input circuit 98 is connected to the crank position sensor 14*c*, the cam position sensor 21*b*, the ignition switch 26, the oil pressure sensor 34, the vacuum sensor 36, etc. The external output circuit 99 is connected to the injection valves 37, the OCV 49, etc.

The ECU 92 constructed as described above controls the valve timing of the intake valves 19 by performing a duty control of the voltage applied to the electromagnetic solenoid 65 of the OCV 49 based on a duty ratio D calculated in accordance with the state of operation of the engine 11. In such valve timing control, the amount of advancement in the valve timing of the intake valves 19 is controlled. The amount of advancement is a value that indicates how much the valve timing is advanced with reference to the most retarded state of the valve timing (defined as "0").

Figure 8:
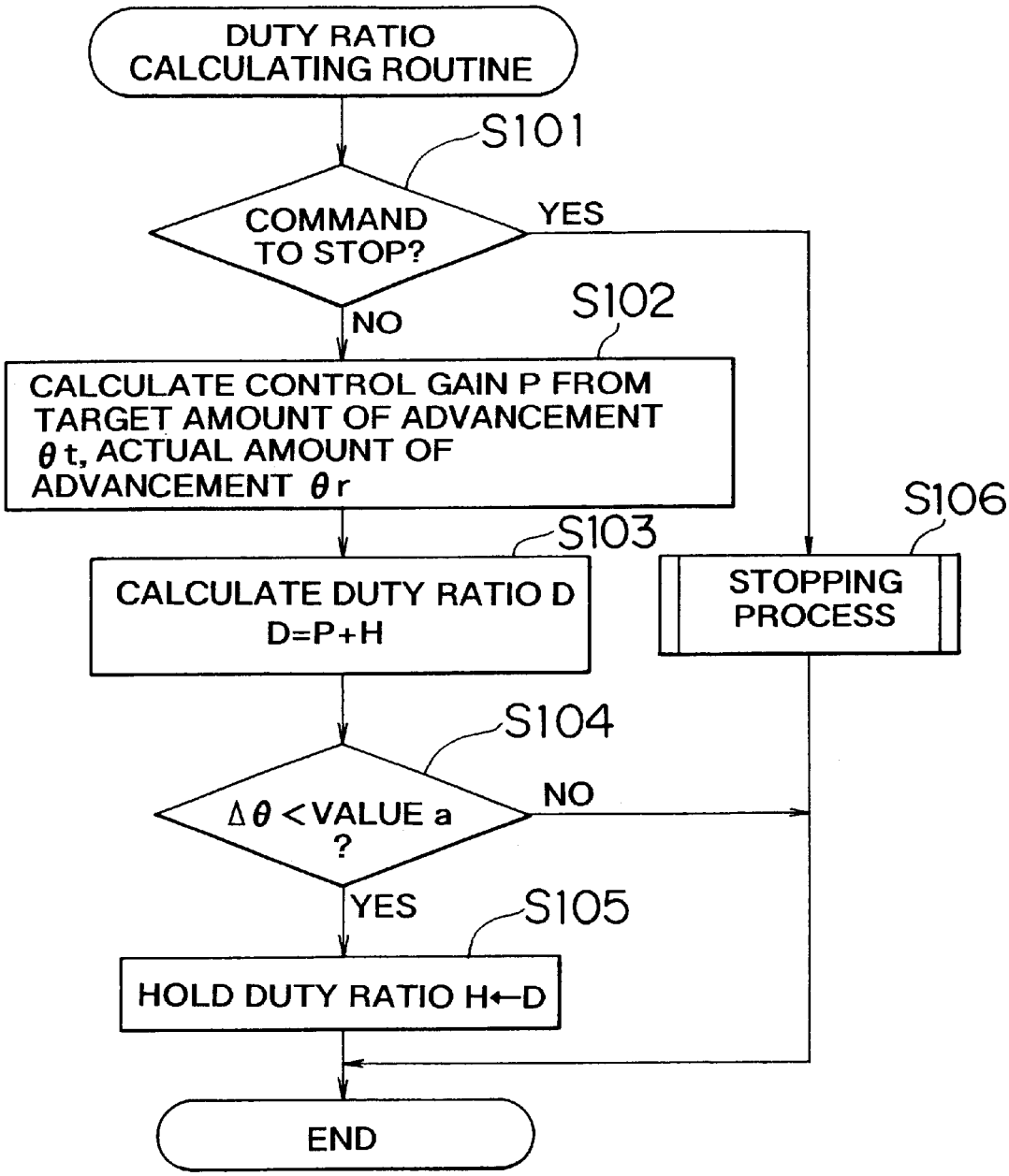
FIG. 8 is a flowchart illustrating a procedure of calculating a duty ratio D.

A procedure of calculating the aforementioned duty ratio D will next be described with reference to the flowchart of FIG. 8, which illustrates a duty ratio calculating routine. The duty ratio calculating routine is executed by the ECU 92, for example, as a time interrupt at every predetermined time.

In the duty ratio calculating routine, the ECU 92 determines, as the processing of step S101, whether a command to stop the engine 11 has been output based on the signal from the ignition switch 26 corresponding to an engine stopping operation performed by a person operating the vehicle. If the stop command has been output, the ECU 92 proceeds to step S106, in which the ECU 92 executes processing needed during the course of stopping the engine 11. If the stop command has not been output, the ECU 92 executes the processing of steps S102 to S105. The processing of steps S102 to S105 is executed to calculate a duty ratio D for an ordinary operation of the engine 11. The duty ratio D is calculated from a control gain P and a hold duty ratio H described below, as in Equation (1).

$$D=P+H \tag{1}$$

The ECU 92 calculates the control gain P in the processing of step S102. The control gain P is a value that is increased and decreased so that the actual valve timing of the intake valves 19 reaches a valve timing suitable for the operation state of the engine 11. To calculate the control gain P, the ECU 92 determines an actual amount of advancement θr, that is, an actual amount of advancement of the valve timing of the intake valves 19, based on the detection signals from the crank position sensor 14*c* and the cam position sensor 21*b*. Furthermore, the ECU 92 determines the engine revolution speed NE based on the detection signal from the crank position sensor 14*c*, and determines the intake pressure PM of the engine 11 based on the detection signal from the vacuum sensor 36. Then, based on the engine revolution speed NE and the intake pressure PM, the ECU 92 calculates a target amount of advancement θt, that is, a target value of the amount of advancement of the valve timing.

Based on the target amount of advancement θt and the actual amount of advancement θr, the ECU 92 calculates the control gain P. The thus-calculated control gain P becomes a value that changes the duty ratio D further toward 0% (toward the valve timing retardation side) if the actual amount of advancement θr further exceeds the target amount of advancement θt, that is, if the actual amount of advancement θr is further toward the timing advancement side of the target amount of advancement θt. The control gain P becomes a value that changes the duty ratio D further toward 100% (toward the valve timing advancement side) if the actual amount of advancement θr is further less than the target amount of advancement θt, that is, further toward the timing retardation side of the target amount of advancement θt. After calculating the control gain P in this manner, the ECU 92 proceeds to step S103.

In the processing of step S103, the ECU 92 calculates the duty ratio D as in Equation (1). The ECU 92 controls the valve timing of the intake valves 19 to a valve timing suitable for the operation state of the engine 11 by duty-controlling the voltage applied to the electromagnetic solenoid 65 of the OCV 49 based on the duty ratio D in a routine that is different from the routine of FIG. 3. The hold duty ratio H used to calculate the duty ratio D as in Equation (1) is a value of the duty ratio D at which the difference $\Delta\theta$ between the actual amount of advancement $\theta r$ and the target amount of advancement $\theta t$ becomes less than a predetermined value a, and which is stored as hold data. The storing of the hold data is performed by the subsequent processing of steps S104 and S105.

As the processing of step S104, the ECU 92 determines whether the difference $\Delta\theta$ is less than the predetermined value a. If "$\Delta\theta<a$" holds, the ECU 92 stores the then duty ratio D as a hold duty ratio H in the processing of step S105. If "$\Delta\theta<a$" does not hold, the ECU 92 temporarily ends the duty ratio calculating routine. The thus-stored hold duty ratio H is a value that serves as a center for increasing and decreasing the duty ratio D when the increasing or decreasing of the duty ratio D based on the control gain P is performed. Although the hold duty ratio H should be "50%", it is usually the case that the hold duty ratio H is slightly greater or smaller than "50%" due to individual variations of variable valve timing mechanisms 24, and the like.

The operation in which the stopping process of S106 is executed after it is determined that the command to stop the engine 11 has been output in step S101, will be described with reference to the timing charts of FIGS. 9A to 9D. FIGS. 9A to 9D indicate transition of the duty ratio D, transition of the amount of advancement of the valve timing of the intake valves 19, transition of the engine revolution speed NE, and transition of the oil pressure in the timing advance-side hydraulic chamber 69 that occur during the course of stopping the engine 11.

Figures 9A, 9B, 9C, 9D:
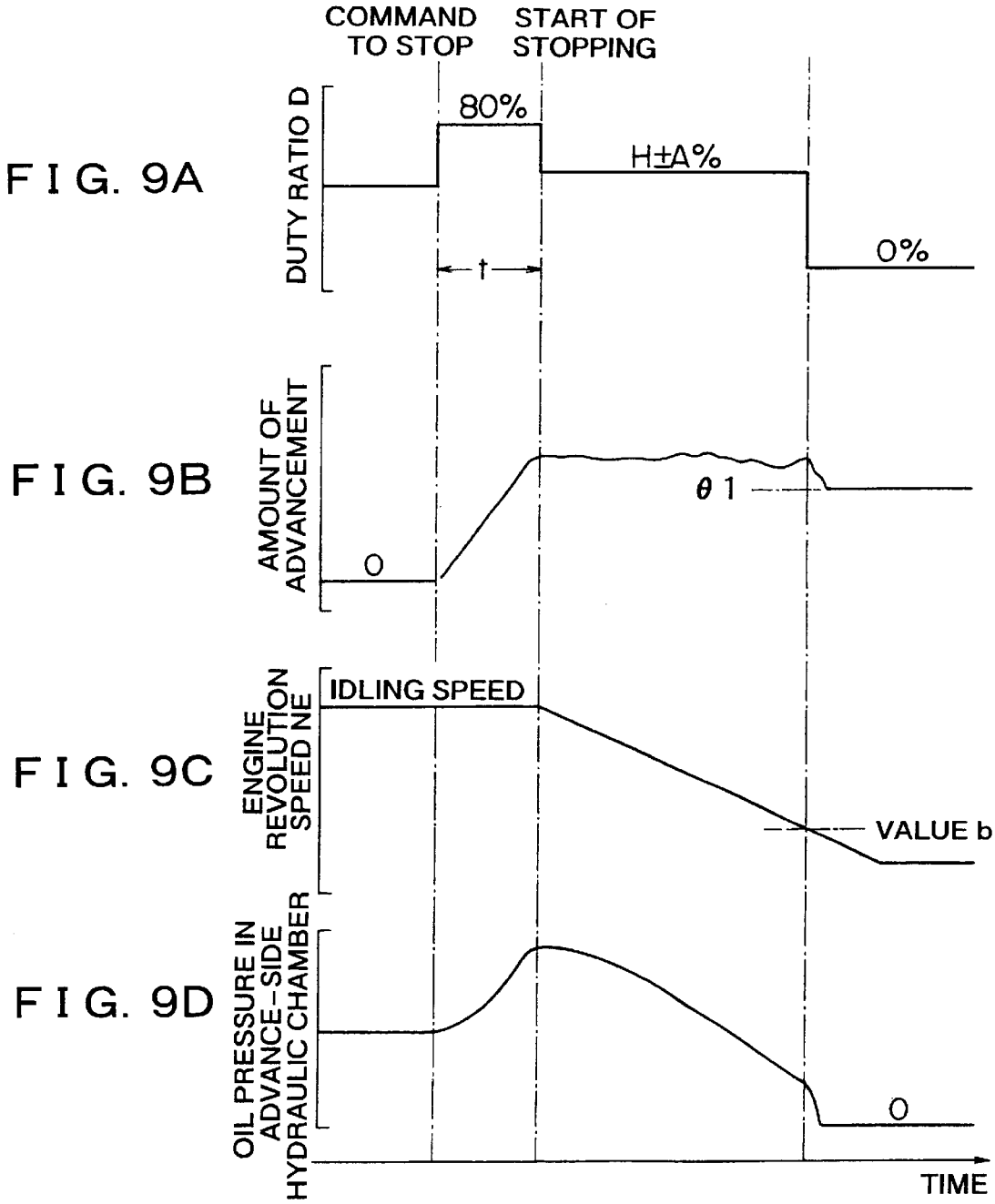
FIGS. 9A to 9D are timing charts indicating transitions of the duty ratio D, the amount of advancement, the engine revolution speed NE and the oil pressure in the timing advance-side hydraulic chamber during the course of stopping the engine.

Before the command to stop the engine 11 is output, the engine 11 is idling, and the engine revolution speed NE is an idling speed as indicated in FIG. 9C. During this situation, the relative rotation phase of the intake camshaft 21 is set to a most retarded state so that the valve timing of the intake valves 19 becomes a state suitable for the idle operation (a most retarded timing). As a result, the amount of advancement of the valve timing becomes "0" as indicated in FIG. 9D.

Then, when the command to stop the engine 11 is output, the ECU 92 fixes the duty ratio D to a value (e.g., 80%) that changes the relative rotation phase of the intake camshaft 21 toward the advanced side as indicated in FIG. 9A. The ECU 92 maintains the fixed state of the duty ratio D for a time t (e.g., 0.1 sec.) so that the relative rotation phase of the intake camshaft 21 becomes a state that is on the advanced side of the phase corresponding to the start-up timing. Until the time t elapses, the oil pressure in the timing advance-side hydraulic chamber 69 gradually rises as indicated in FIG. 9D and the amount of timing advancement gradually increases as indicated in FIG. 9B.

The time t is a value that is determined beforehand through experiments or the like so that the relative rotation phase of the intake camshaft 21 reaches a state that is shifted to the advanced side from the phase corresponding to the start-up timing by an amount corresponding to the amount of fluctuation of the relative rotation phase of the intake camshaft 21 involved with a torque fluctuation of the intake camshaft 21 caused by the opening and closing of the intake valves 19 (hereinafter, simply referred to as "amount of phase fluctuation"). Therefore, at the elapse of the time t, the relative rotation phase of the intake camshaft 21 is set to a state shifted to the advanced side from the phase corresponding to the start-up timing by an amount corresponding to the amount of phase fluctuation, or to a state slightly advanced from the aforementioned state. At this moment, the amount of advancement indicated in FIG. 9B becomes a value that is greater than the amount of advancement $\theta 1$ corresponding to the start-up timing.

When the time t elapses, the ECU 92 starts to stop the engine 11 by fixing the duty ratio D to a value ("H±A") obtained through addition of a predetermined value A to the hold duty ratio H or subtraction of the value A from the hold duty ratio H as indicated in FIG. 9A, and by stopping fuel injection performed by the injection valves 37. After the stopping of the engine 11 is initiated, the engine revolution speed NE gradually decreases as indicated in FIG. 9C. Along with the decreasing engine revolution speed NE, the amount of hydraulic oil ejected from the oil pump 52 decreases, so that the oil pressure in the supply passage 50 decreases. Therefore, the oil pressure in the timing advance-side hydraulic chambers 69 and the timing retard-side hydraulic chambers 70 also decreases.

While the duty ratio D is fixed to "H±A"% (a value that holds the relative rotation phase of the intake camshaft 21), the intake camshaft 21 undergoes torque fluctuations due to the opening and closing of the intake valves 19, and receives rotating torque in the timing retardation direction as a reaction force involved in the opening and closing of the intake valves 19. The rotating torque gradually increases with decreases in the engine revolution speed NE. The relative rotation phase of the intake camshaft 21 fluctuates to the advanced side and the retarded side due to the aforementioned fluctuations in torque, and gradually changes to the retarded side due to the rotating torque. As a result, the amount of advancement indicated in FIG. 9D (more precisely, the mean value of the amount of advancement that varies with fluctuations in the relative rotation phase) gradually changes to smaller values.

Subsequently, when the engine revolution speed NE decreases below a predetermined value b as indicated in FIG. 9C, the ECU 92 sets the duty ratio D to, for example, 0% as indicated in FIG. 9A, so that the oil pressure in the timing advance-side hydraulic chambers 69 decreases toward a value that allows the stopper mechanism 56 to perform the fixing operation. While the duty ratio D is fixed to "H±A"%, the oil pressure in the timing advance-side hydraulic chambers 69 tends to decrease with decreases in the oil pressure in the supply passage 50, that is, with decreases in the engine revolution speed NE. The predetermined value b is set to a value corresponding to the engine revolution speed NE (oil pressure in the supply passage 50) occurring before the oil pressure in the timing advance-side hydraulic chambers 69 reaches a value that allows the stopper mechanism 56 to perform the fixing operation as the engine revolution speed NE decreases while the duty ratio D is fixed to "H±A"%. This makes it possible to precisely reduce the oil pressure in the timing advance-side hydraulic chambers 69 before the stopper mechanism 56 performs the fixing operation.

If the duty ratio D is set to 0%, the oil pressure in the timing retard-side hydraulic chambers 70 increases and the oil pressure in the timing advance-side hydraulic chambers 69 decreases, so that the vanes 68*a*–68*d* tend to move toward the timing retardation side, and therefore compress hydraulic oil remaining in the timing advance-side hydraulic chambers 69. The aforementioned compression causes a delay in decrease of the oil pressure in the timing advance-side hydraulic chambers 69. This delay tends to increase with increase in the oil pressure in the supply passage 50 occurring at the start of the compressions, that is, with increase in the engine revolution speed NE occurring at the start of the compressions. Therefore, the aforementioned predetermined value b, serving as a criterion for setting the duty ratio D to 0%, is set to a value corresponding to the engine revolution speed NE (oil pressure in the supply passage 50) that avoids an event in which the fixing operation of the stopper mechanism 56 is impeded by the delay in decrease of the oil pressure in the timing advance-side hydraulic chamber 69 caused by the aforementioned compression of hydraulic oil. The aforementioned value adopted may be, for example, 200 rpm.

While the oil pressure in the timing advance-side hydraulic chambers 69 is being quickly decreased toward "0" as indicated in FIG. 9D by setting the duty ratio D to 0% as mentioned above, the stopper mechanism 56 tends to perform the fixing operation, that is, the stopper pin 58 tends to protrude into the timing advance-side hydraulic chamber 69. At this moment, the amount of advancement indicated in FIG. 9B (corresponding to the relative rotation phase of the intake camshaft 21) is kept greater than the amount of advancement θ1 although the amount of advancement is gradually decreasing due to the aforementioned rotating torque acting on the intake camshaft 21.

The relative rotation phase of the intake camshaft 21 fluctuates due to the aforementioned torque fluctuation. Therefore, when during the phase fluctuation, the relative rotation phase of the intake camshaft 21 is in a state on the advanced side of the phase corresponding to the start-up timing, the stopper pin 58 of the stopper mechanism 56 protrudes into the timing advance-side hydraulic chamber 69. Even if the amount of advancement indicated in FIG. 9B is less than the amount of advancement θ1 when the stopper mechanism 56 is about to perform the fixing operation, the stopper pin 58 likewise protrudes into the timing advance-side hydraulic chamber 69 when the relative rotation phase of the intake camshaft 21 becomes a state on the advanced side of the phase corresponding to the start-up timing by above-fluctuation.

After the duty ratio D is set to 0%, the relative rotation phase of the intake camshaft 21 quickly changes toward the phase corresponding to the start-up timing due to the oil pressure remaining in the timing retard-side hydraulic chambers 70 and the aforementioned rotating torque acting on the intake camshaft 21 as a reaction force at the time of opening and closing the intake valves 19. The change of the relative rotation phase to the retarded side of the phase corresponding to the start-up timing is restricted by the stopper pin 58 of the stopper mechanism 56. Therefore, the relative rotation phase of the intake camshaft 21 is fixed at the phase corresponding to the start-up timing only with respect to the retarded side thereof, and is therefore temporarily held at the aforementioned phase.

Subsequently, when the oil pressure in the timing retard-side hydraulic chambers 70 further decreases, the lock pin 78 of the lock mechanism 76 tends to protrude from the housing hole 81 toward the hole 79. At this moment, the relative rotation phase of the intake camshaft 21 has been held at the phase corresponding to the start-up timing by the stopper mechanism 56, and the housing hole 81 and the hole 79 has been precisely aligned. Therefore, the protruding lock pin 78 is precisely received in the hole 79. Thus, during the course during which the engine 11 is about to stop, the relative rotation phase of the intake camshaft 21 is precisely fixed by the stopper mechanism 56 and the lock mechanism 76.

Figure 10:
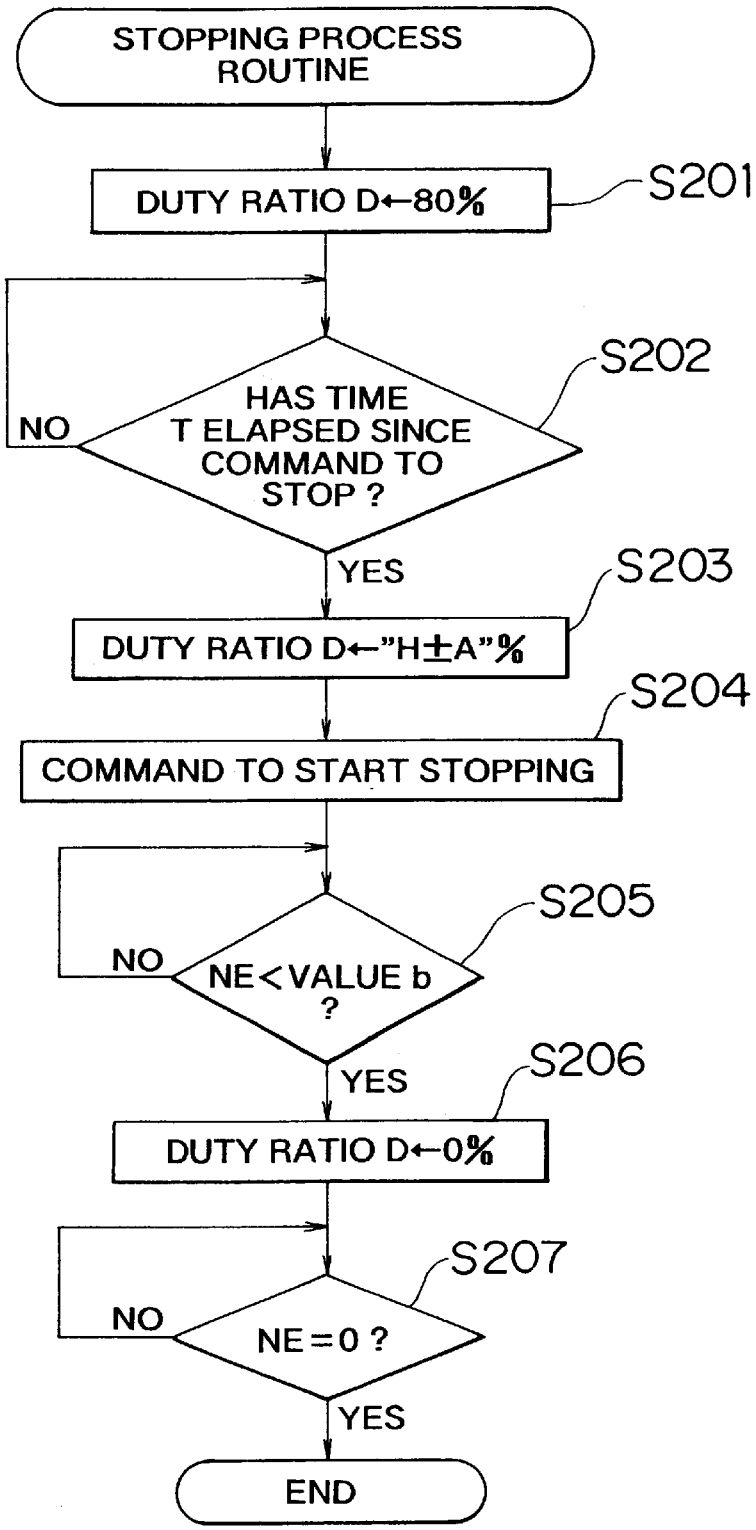
FIG. 10 is a flowchart illustrating a procedure of an engine stopping process.

A procedure of the above-described stopping process will be described with reference to the flowchart of FIG. 10, which illustrates a stopping process routine. The stopping process routine is executed by the ECU 92 every time step S106 in the duty ratio calculating routine (FIG. 8) is reached. That is, when a process for stopping the engine 11 is performed, the stopping process routine is started.

In the processing of step S201 in the stopping process routine, the ECU 92 fixes the duty ratio D to 80%. Subsequently in the processing of step S202, the ECU 92 determines whether a time t has elapsed following the output of the command to stop the engine 11. If it is determined that the time t has elapsed, the ECU 92 fixes the duty ratio D to a value "H±A"% in the processing of step S203. Subsequently in the processing of step S204, the ECU 92 outputs a command to initiate stopping of the engine 11. Based on the command, the fuel injection by the injection valves 37 is stopped, and thus the stopping of the engine 11 is initiated. After the stopping of the engine 11 has started, the engine revolution speed NE gradually decreases. In the processing of step S205, the ECU 92 determines whether the engine revolution speed NE is less than the predetermined value b. If "NE<b" holds, the ECU 92 fixes the duty ratio D to 0% in the processing of step S206. Subsequently in the processing of step S207, the ECU 92 determines whether the engine revolution speed NE is "0". If "NE=0" holds, the ECU 92 ends the stopping process routine.

The above-described embodiment achieves the following advantages.

(1) While the engine 11 is in the course of stopping, the relative rotation phase of the intake camshaft 21 is changed to the advanced side of the phase corresponding to the start-up timing, and subsequently the duty ratio D is fixed to a value that holds the aforementioned relative rotation phase. During this state, the relative rotation phase is kept near the phase corresponding to the start-up timing and on the advanced side of the phase. Therefore, during the course of stopping the engine 11, the relative rotation phase of the intake camshaft 21 changes within the vicinity of the phase corresponding to the start-up timing, independently of the state of phase occurring during the idle operation preceding the start of stopping the engine 11. Hence, the relative rotation phase of the intake camshaft 21 can be changed to the vicinity of the phase corresponding to the start-up timing during the course of stopping the engine 11, while during the idle operation, before the stopping of the engine 11 starts, the relative rotation phase of the intake camshaft 21 is set to a phase suitable for the idle operation (a most retarded phase). Thus, during the course of stopping the engine 11, the relative rotation phase of the intake camshaft 21 becomes a state in which the fixation by the stopper mechanism 56 and the lock mechanism 76 can be performed in the phase corresponding to the start-up timing.

(2) During the course of stopping the engine 11, the relative rotation phase of the intake camshaft 21 is held by fixing the value of the duty ratio D to the value "H±A"% determined from the hold duty ratio H. The hold duty ratio H is a value stored during operation of the engine 11. Therefore, when the duty ratio D is fixed to a value as described above, the value of fixation ("H±A"%) can easily be determined from the hold duty ratio H stored during operation of the engine 11.

(3) The hold duty ratio H is a value of the duty ratio D at which the difference Δθ between the actual amount of advancement θr and the target amount of advancement θt becomes less than a predetermined value a, and which is stored as hold data. The hold duty ratio H is updated at every predetermined period provided that the difference Δθ is less than the predetermined value a. Therefore, the hold duty ratio H is updated even during the idle operation prior to the start of stopping the engine 11. The latent hold duty ratio H is used to determine a value ("H±A"%) to which the duty ratio D is fixed during the course of stopping the engine 11. Since the value "H±A"% can be determined from the latest hold duty ratio H, it becomes possible to precisely hold the relative rotation phase of the intake camshaft 21 by fixing the duty ratio D to "H±A"%.

(4) When the engine revolution speed NE decreases below the predetermined value b (e.g., 200 rpm) after the duty ratio D has been fixed to "H±A"%, the duty ratio D is then set to 0% so as to reduce the oil pressure in the timing advance-side hydraulic chambers 69 to a value that cause the stopper mechanism 56 to perform the fixing operation. In response, the oil pressure in the timing retard-side hydraulic chambers 70 rises, and the oil pressure in the timing advance-side hydraulic chambers 69 falls, so that the vanes 68*a*–68*d* tend to shift toward the retarded side, thereby compressing the hydraulic oil remaining in the timing advance-side hydraulic chambers 69. The delay in decrease of the oil pressure in the timing advance-side hydraulic chamber 69 increases with increase in the oil pressure in the supply passage 50 occurring when the compression starts, that is, with increase in the engine revolution speed NE occurring when the compression starts. The predetermined value b is set to a value corresponding to the engine revolution speed NE (oil pressure in the supply passage 50) that avoids an event in which the fixing operation of the stopper mechanism 56 is impeded by the delay in decrease of the oil pressure in the timing advance-side hydraulic chamber 69 caused by the aforementioned compression of hydraulic oil. Therefore, by setting the duty ratio D to 0%, the oil pressure in the timing advance-side hydraulic chamber 69 is quickly reduced toward a value that causes the stopper mechanism 56 to perform the fixing operation. Thus, it becomes possible to precisely cause the stopper mechanism 56 to perform the fixing operation during the course of stopping the engine 11.

(5) The predetermined value b is set to a value corresponding to the engine revolution speed NE (oil pressure in the supply passage 50) occurring before the oil pressure in the timing advance-side hydraulic chambers 69 reaches a value that allows the stopper mechanism 56 to perform the fixing operation as the engine revolution speed NE decreases while the duty ratio D is fixed to "H∓A"%. This makes it possible to precisely reduce the oil pressure in the timing advance-side hydraulic chambers 69 by setting the duty ratio D to 0% before the stopper mechanism 56 performs the fixing operation.

(6) If during the course of stopping the engine 11, the duty ratio D is fixed to the value "H±A"%, the relative rotation phase of the intake camshaft 21 fluctuates to the advanced side and to the retarded side due to the aforementioned torque. fluctuation, and gradually changes to the retarded side due to the aforementioned rotating torque. Let it be assumed that the relative rotation phase of the intake camshaft 21 continues to be on the retarded side of the phase corresponding to the start-up timing. In that case, protrusion of the stopper pin 58 is hindered by the vane 68*a,* so that the fixing operation of the stopper mechanism 56 cannot be performed. However, during the course of stopping the engine 11, the relative rotation phase changes to a state that is shifted from the phase corresponding to the start-up timing to the advanced side by an amount corresponding to the amount of phase fluctuation. Therefore, even if the relative rotation phase of the intake camshaft 21 gradually changes to the retarded side while fluctuating when the duty ratio D is subsequently fixed to the "H±A"%, the aforementioned hindrance of the fixing operation of the stopper mechanism 56 can be prevented.

(7) Immediately after the command to stop the engine 11 is output in the course of stopping of the engine 11, the stopping of the engine 11 is not initiated, but the relative rotation phase of the intake camshaft 21 is changed to a state on the advanced side of the phase corresponding to the start-up timing. After that, the duty ratio D is set to the value "H±A"%. After this state is established, the stopping of the engine 11 is initiated, so that the oil pressure in the timing advance-side hydraulic chambers 69 and the timing retard-side hydraulic chambers 70 starts to decreases with decrease in the engine revolution speed NE. Therefore, the process of changing the relative rotation phase of the intake camshaft 21 to the advanced side of the phase corresponding to the start-up timing during the course of stopping the engine 11 can be precisely performed under a condition that the oil pressure in the timing advance-side hydraulic chambers 69 and the timing retard-side hydraulic chambers 70 is stable.

The foregoing embodiment may be modified, for example, as follows.

When the time t, during which the duty ratio D is fixed to 80%, elapses during the course of stopping the engine 11, the embodiment determines that the relative rotation phase of the intake camshaft 21 is in a state on the advanced side of the phase (predetermined advanced phase) corresponding to the start-up timing, and then sets the duty ratio D to "H±A"%. The invention is not limited to that embodiment. For example, when the actual amount of advancement θr exceeds the amount of advancement θ1 by an amount corresponding to the aforementioned amount of phase fluctuation, it is possible to determine that the relative rotation phase of the intake camshaft 21 is in a state on the advanced side of the phase (predetermined advanced phase) corresponding to the start-up timing, and to set the duty ratio D to "H±A"%.

During the course of stopping the engine 11, the embodiment starts stopping the engine 11 at the elapse of at least the time t following the output of the command to stop the engine 11 after the relative rotation phase of the intake camshaft 21 has changed to the advanced side of the phase (predetermined advanced state) corresponding to the start-up timing. The invention is not limited to that embodiment. For example, the stopping of the engine 11 may be started before the relative rotation phase of the intake camshaft reaches a state on the advanced side of the predetermined advanced state (before the time t elapses) after the command to stop the engine 11 has been output. The stopping of the engine 11 may also be started simultaneously with the output of the command to stop the engine 11.

During the course of stopping the engine 11, the embodiment sets and holds the duty ratio D to 80% during the time t so that the relative rotation phase of the intake camshaft 21 reaches a state that is shifted from the phase (predetermined advanced state) corresponding to the start-up timing to the advanced side by an amount corresponding to the amount of phase fluctuation. The invention is not limited to that embodiment. For example, it is also possible to set the duty ratio D to a value other than 80%, for example, to 100%, and to correspondingly change the time t.

As for the method for changing the relative rotation phase of the intake camshaft 21 to the advanced side, the above-described method in which the duty ratio D is fixed to 80%, 100% or the like for the time t may be replaced by a different method. For example, it is possible to adopt a method in which a target amount of advancement θt is set as the amount of advancement corresponding to a state in which the relative rotation phase is advanced from the predetermined advanced state by the amount of phase fluctuation, and the duty ratio D (control gain P) is decreased and increased so as to reduce the difference Δθ between the target amount of advancement θt and the actual amount of advancement θr, and thereby the relative rotation phase is changed to a state that is at an amount corresponding to the amount of phase fluctuation, to the advanced side of the predetermined advanced state. The adoption of the method in which the duty ratio D is fixed to a fixed value, for example, 80% or 100% , achieves an advantage of simplification of the setting of the duty ratio D. Furthermore, if as in the embodiment, the relative rotation phase is changed by continuing the state in which the duty ratio D is fixed to 80% or 100% for the time t, the relative rotation phase can be precisely changed as described above even if the actual amount of advancement θr is not accurate during the course of stopping the engine 11.

During the course of stopping the engine 11, the embodiment changes the relative rotation phase of the intake camshaft 21 to a state that is shifted from the phase (predetermined advanced state) corresponding to the start-up timing to the advanced side by the amount corresponding to the aforementioned amount of phase fluctuation, and then fixes the duty ratio D to "H±A"%. However, it is also possible to change the relative rotation phase of the intake camshaft 21 to a state that is further shifted to the advanced side and then set the duty ratio D to "HiA"%. In this case, when the duty ratio D is changed to 0% from "H±A"%, the relative rotation phase of the intake camshaft 21 changes in the direction of the retarded side to the phase corresponding to the start-up timing.

During the course of stopping the engine 11, it is also possible to fix the duty ratio D to the hold duty ratio H, or to a fixed value of, for example, "50%", instead of fixing the duty ratio D to the value "H±A"% determined from the hold duty ratio H. The duty ratio D may also be fixed to, for example, a value "50±A"% obtained by adding a predetermined constant A to or subtracting the constant A from the fixed value "50%".

The fixation of the duty ratio D to a value (e.g., "H±A"%) that holds the relative rotation phase of the intake camshaft 21 may be performed during a predetermined period between the completion of the stopping of the engine 11 and the start of an autonomous operation of the engine 11, as well as during the course of stopping the engine 11.

During the course of stopping the engine 11, the duty ratio D is set to the value (0%) that reduces the oil pressure in the timing advance-side hydraulic chambers 69 in the embodiment. It is determined whether to set the duty ratio D to 0% based on whether the engine revolution speed NE is less than predetermined value b in the embodiment. However, the determination as to whether to set the duty ratio D to 0% may instead be accomplished based on whether the oil pressure determined based on the detection signal from the oil pressure sensor 34 is less than a predetermined criterion corresponding to the predetermined value b.

With regard to the reduction of the oil pressure in the timing advance-side hydraulic chambers 69 as described above, it is not altogether necessary to set the duty ratio D to 0%, it is also possible to set the duty ratio D to a value that is less than 50%.

The setting of the duty ratio D to 0% or the like may be performed during a predetermined period between the completion of the stopping of the engine 11 and the start of an autonomous operation of the engine 11, as well as during the course of stopping the engine 11. For example, if during the predetermined period between the completion of the stopping of the engine 11 and the start of an autonomous operation of the engine 11, the duty ratio D is fixed to a value ("H±A"%) that holds the relative rotation phase of the intake camshaft 21, the duty ratio D may be subsequently set to 0% or the like.

It is also possible to design the lock mechanism 76 so as to perform a fixing operation similarly to the stopper mechanism 56, and to omit the stopper mechanism 56.

In the illustrated embodiment, the controller (the ECU 92) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An internal combustion engine valve timing control apparatus comprising:

a variable valve timing mechanism that varies a relative rotation phase of a camshaft with respect to a crankshaft of an internal combustion engine based on a fluid pressure in a timing advance-side hydraulic chamber and a fluid pressure in a timing retard-side hydraulic chamber with respect to at least a timing retarded side;

a stopper that fixes the relative rotation phase of the camshaft at a predetermined advanced state that is between a most advanced state and a most retarded state and that is advanced from the most retarded state by a predetermined amount;

a fluid pressure adjustor that adjusts the fluid pressure in the timing advance-side hydraulic chamber and the fluid pressure in the timing retard-side hydraulic chamber; and a controller that controls the fluid pressure adjustor so that the relative rotation phase of the camshaft becomes a state that is on an advanced side of the predetermined advanced state during a course of stopping the internal combustion engine, and then controls the fluid pressure adjustor to hold the relative rotation phase of the camshaft.

2. An internal combustion engine valve timing control apparatus according to claim 1, wherein the controller sets a duty ratio of the fluid pressure adjustor to a constant value to cause the relative rotation phase of the camshaft to reach the state on the advanced side of the predetermined advanced state during the course of stopping the internal combustion engine.

3. An internal combustion engine valve timing control apparatus according to claim 1, wherein the controller increases and decreases a duty ratio of the fluid pressure adjustor to cause the relative rotation phase of the camshaft to reach the state on the advanced side of the predetermined advanced state during the course of stopping the internal combustion engine, so that a difference between a present amount of advancement of the relative rotation phase and an amount of advancement of the predetermined advanced state decreases.

4. An internal combustion engine valve timing control apparatus according to claim 1, wherein when controlling the fluid pressure adjustor so that the relative rotation phase of the camshaft reaches the state on the advanced side of the predetermined advanced state during the course of stopping the internal combustion engine, the controller controls the fluid pressure adjustor so that the relative rotation phase of the camshaft reaches a state that is shifted beyond the predetermined advanced state to the advanced side by at least an amount corresponding to an amount of fluctuation of the relative rotation phase caused by a torque fluctuation occurring when the camshaft rotates.

5. An internal combustion engine valve timing control apparatus according to claim 1, wherein the controller sets a duty ratio of the fluid pressure adjustor to a constant value in order to hold the relative rotation phase of the camshaft.

6. An internal combustion engine valve timing control apparatus according to claim 1, wherein the controller increases and decreases a duty ratio of the fluid pressure adjustor so that an actually measured value of the relative rotation phase of the camshaft becomes equal to a target value of the relative rotation phase during an operation of the internal combustion engine, and stores the duty ratio occurring when a difference between the actually measured value and the target value becomes equal to or less than a predetermined value, as a hold datum, and sets the duty ratio to the value that holds the relative rotation phase of the camshaft, to a value determined from the hold datum.

7. An internal combustion engine valve timing control apparatus according to claim 1, further comprising a fluid ejector that ejects a fluid supplied to the timing advance-side hydraulic chamber and the timing retard-side hydraulic chamber, and wherein:

the stopper operates so as to fix the relative rotation phase of the camshaft to the predetermined advanced state when the fluid pressure in the timing advance-side hydraulic chamber is equal to or less than a predetermined value, and when a pressure of a fluid ejected from the fluid ejector is equal to or less than a predetermined criterion value after the fluid pressure adjustor is controlled to hold the relative rotation phase of the camshaft, the controller controls the fluid pressure adjustor in such a manner that the fluid pressure in the timing advance-side hydraulic chamber decreases.

8. An internal combustion engine valve timing control apparatus according to claim 7, further comprising an oil pressure detector provided at a downstream side of the fluid ejector device, wherein:

the oil pressure detector detects the pressure of the fluid ejected from the fluid ejector; and when an oil pressure detected by the oil pressure detector is equal to or less than a predetermined value, the controller controls the fluid pressure adjustor so that the fluid pressure in the timing advance-side hydraulic chamber decreases.

9. An internal combustion engine valve timing control apparatus according to claim 7, wherein:

the fluid ejector ejects the fluid supplied to the timing advance-side hydraulic chamber and the timing retard-side hydraulic chamber in an amount determined in accordance with a revolution speed of the internal combustion engine; and when the revolution speed of the internal combustion engine is equal to or less than a predetermined value, the controller controls the fluid pressure adjustor so that the fluid pressure in the timing advance-side hydraulic chamber decreases.

10. An internal combustion engine valve timing control apparatus according to claim 1, wherein:

the controller controls the fluid pressure adjustor, for a first time period, such that the relative rotation phase of the camshaft becomes the state on the advanced side of the predetermined advanced state when a command to stop the internal combustion engine is output; and the valve timing control apparatus further comprises an engine stop initiator that initiates stopping of the internal combustion engine after the relative rotation phase of the camshaft becomes the state on the advanced side of the predetermined advanced state based on the control of the fluid pressure adjustor for the first time period.

11. A method of controlling a valve timing control apparatus having a variable valve timing mechanism that varies a relative rotation phase of a camshaft with respect to a crankshaft of an internal combustion engine based on a fluid pressure in a timing advance-side hydraulic chamber and a fluid pressure in a timing retard-side hydraulic chamber, wherein the fluid pressure in the timing advance-side hydraulic chamber and the fluid pressure in the timing retard-side hydraulic chamber are adjusted by a fluid pressure adjustor, the control method comprising:

a first step of controlling the fluid pressure adjustor so that the camshaft for adjusting at least one of an intake valve and an exhaust valve is set to a state that is advanced from a most retarded state by a predetermined amount, when a command to stop the internal combustion engine is output;

a second step of controlling the fluid pressure adjustor to hold the relative rotation phase of the camshaft to a state that is on an advanced side of a predetermined advanced state that is between a most advanced state and the most retarded state, after the first step; and a third step of fixing the camshaft at the predetermined advanced state after the second step.

12. A method according to claim 11, wherein in the first step, a duty ratio of the fluid pressure adjustor is controlled to a constant value.

13. A method according to claim 11, wherein in the first step, a duty ratio of the fluid pressure adjustor is increased and decreased so that a difference between a present amount of advancement and an amount of advancement of the predetermined advanced state decreases.

14. A method according to claim 11, wherein when the fluid pressure adjustor is controlled so that the relative rotation phase of the camshaft becomes the state on the advanced side of the predetermined advanced state during a course of stopping the internal combustion engine, during the first step, a duty ratio of the fluid pressure adjustor is set so that the relative rotation phase becomes the state that is shifted from the predetermined advanced state to the advanced side by at least an amount corresponding to an amount of fluctuation of the relative rotation phase caused by a torque fluctuation occurring when the camshaft rotates.

15. A method according to claim 11, wherein the first step includes (a) a step of determining whether a predetermined time has elapsed after controlling the fluid pressure adjustor, and (b) a step of, when the predetermined time has elapsed, shifting to a step of holding the camshaft.

16. A method according to claim 11, wherein in the second step, a duty ratio of the fluid pressure adjustor is maintained at a constant value.

17. A method according to claim 11, further comprising (a) a step of increasing and decreasing a duty ratio of the fluid pressure adjustor so that an actually measured value of the relative rotation phase of the camshaft becomes equal to a target value of the relative rotation phase during an operation of the internal combustion engine, and (b) a step of storing, as a hold datum, the duty ratio occurring when a difference between the actually measured value and the target value becomes equal to or less than a predetermined value, wherein in the second step, the duty ratio is set to a value that is determined from the hold datum.

18. A method according to claim 11, wherein the valve timing control apparatus further comprises a fluid ejector that ejects a fluid supplied to the timing advance-side hydraulic chamber and the timing retard-side hydraulic chamber, and in the third step, the fluid pressure adjustor is controlled so that the fluid pressure in the timing advance-side hydraulic chamber decreases, if the pressure of the fluid ejected by the fluid ejector is equal to or less than a predetermined criterion value.

19. A method according to claim 18, wherein the valve timing control apparatus further comprises a pressure detector provided at a downstream side of the fluid ejector, the pressure detector detecting the pressure of the fluid, and in the third step, it is determined whether the pressure of the fluid is equal to or less than the predetermined criterion value based on the pressure detected by the pressure detector.

20. A method according to claim 18, wherein the fluid ejector ejects the fluid supplied to the timing advance-side hydraulic chamber and the timing retard-side hydraulic chamber in an amount determined in accordance with a revolution speed of the internal combustion engine, and in the third step, it is determined whether the pressure of the fluid is equal to or less than the predetermined criterion value based on the revolution speed of the internal combustion engine.

21. A method according to claim 11, wherein:

the first step is started after the command to stop the internal combustion engine is output; and when the relative rotation phase of the camshaft is the state that is on the advanced side of the predetermined advanced state after the command to stop is output, the internal combustion engine starts to be stopped.

22. An internal combustion engine valve timing control apparatus comprising:

a variable valve timing mechanism that varies a relative rotation phase of a camshaft with respect to a crankshaft of an internal combustion engine based on a fluid pressure in a timing advance-side hydraulic chamber and a fluid pressure in a timing retard-side hydraulic chamber;

fixing means for fixing the relative rotation phase of the camshaft at a predetermined advanced state that is between a most advanced state and a most retarded state and that is advanced from the most retarded state by a predetermined amount, with respect to at least a timing retarded side;

fluid pressure adjusting means for adjusting the fluid pressure in the timing advance-side hydraulic chamber and the fluid pressure in the timing retard-side hydraulic chamber; and control means for, during a first time period until the relative rotation phase of the camshaft becomes a state that is on an advanced side of the predetermined advanced state during a course of stopping the internal combustion engine, controlling the fluid pressure adjusting means such that the relative rotation phase of the camshaft becomes the state on the advanced side of the predetermined advanced state, and then, after the first time period, controlling the fluid pressure adjusting means for a second time period to hold the relative rotation phase of the camshaft.

* * * * *